US011439260B2

(12) United States Patent
Rees

(10) Patent No.: US 11,439,260 B2
(45) Date of Patent: Sep. 13, 2022

(54) NON-SPILL CUP AND FLUID CONTROL VALVE SYSTEM WITH ALL ROUND DRINKING RIM

(71) Applicant: AR Design Consulting Limited, Newcastle Upon Tyne (GB)

(72) Inventor: Arnold Rees, Newcastle Upon Tyne (GB)

(73) Assignee: AR Design Consulting Limited, Newcastle Upon Tyne (GB)

( * ) Notice: Subject to any disclaimer, the term of this patent is extended or adjusted under 35 U.S.C. 154(b) by 120 days.

(21) Appl. No.: 16/763,176

(22) PCT Filed: Nov. 23, 2018

(86) PCT No.: PCT/GB2018/053394
§ 371 (c)(1),
(2) Date: May 11, 2020

(87) PCT Pub. No.: WO2019/102210
PCT Pub. Date: May 31, 2019

(65) Prior Publication Data

US 2020/0383505 A1 Dec. 10, 2020

(30) Foreign Application Priority Data

Nov. 27, 2017 (GB) ..... 1719635

(51) Int. Cl.
*A47G 19/22* (2006.01)

(52) U.S. Cl.
CPC ..... *A47G 19/2272* (2013.01)

(58) Field of Classification Search
CPC ..... A47G 19/2272; A47G 19/2205; A47G 19/2216; A47G 19/2266; B65D 47/246;
(Continued)

(56) References Cited

U.S. PATENT DOCUMENTS 8,453,870 B2 * 6/2013 Berg ..... A47G 19/2272 220/703
2015/0102032 A1 * 4/2015 Dunn ..... A47G 19/2272 220/231

FOREIGN PATENT DOCUMENTS

GB 2531991 A 5/2016
WO WO-0211587 A1 2/2002
(Continued)

OTHER PUBLICATIONS

Vistisen, Lars; International Search Report; PCT/GB2018/053394; dated Feb. 21, 2019; 3 pages.

*Primary Examiner* — Don M Anderson
*Assistant Examiner* — Madison L Poos
(74) *Attorney, Agent, or Firm* — Burr & Forman LLP

(57) ABSTRACT

A non-spill drinking valve system includes a generally circular collar including a flange extending radially inwardly, an aperture defined by the flange and a circumferential drinking rim above the flange; and a flexible valve member removably attachable to the collar, comprising a first lip that engages with a lower face of the flange to create a liquid seal, and a second lip which engages with the drinking rim of the collar; wherein, when pressure is applied to the flexible valve member, the first lip is caused to disengage from the lower face of the flange and the second lip is caused to disengage from the drinking rim of the collar.

21 Claims, 16 Drawing Sheets

(58) Field of Classification Search
CPC ..... B65D 47/32; B65D 47/2031; B65D 47/2018; B65D 43/0212; B65D 2543/00046; B65D 47/04
USPC ..... 220/303, 714, 203.16, 231; 215/11.5, 215/311
See application file for complete search history.

(56) References Cited

FOREIGN PATENT DOCUMENTS

| | | | |
|---|---|---|---|
| WO | WO-2009126042 | A1 | 10/2009 |
| WO | WO-2012036540 | A1 | 3/2012 |
| WO | WO-2017091639 | A1 | 6/2017 |

* cited by examiner

NON-SPILL CUP AND FLUID CONTROL VALVE SYSTEM WITH ALL ROUND DRINKING RIM

This invention relates to improvements in a non-spill drinking cup and fluid control valve system, which allows the user to drink from the cup in any position around the cup rim and which remains in a sealed condition to eliminate potential liquid spillage from the cup, if inadvertently is knocked over. In particular the invention relates to improvements in a non-spill drinking vessel, which comprises a cup base, a flexible valve member and lid assembly system.

INTRODUCTION

Non-spill drinking vessels, typically cups and beakers fitted with valve type lids that allow the user to drink from any position around the cup rim and which prevent spillage, are well known. They are typically used to assist an infant to transition from drinking from a feeding bottle or spouted cup, more commonly known as 'sippy cups', to open cup drinking as typically used by both children and adults alike.

The lids of these drinking cups traditionally have apertures, that allow liquid to flow from the container via specific flow channels, together with flexible valves to both control the flow of that liquid and also seal the contents of the cup at the extreme rim of the cup, between a circular valve member and a semi-rigid cup rim member.

The main disadvantage with all of these types of cup relates to the difficulty that the user experiences whilst drinking, maintaining an open liquid flow path when drinking and, more importantly, maintaining an adequate seal so that the liquid contents are prevented from leaking out of valve assembly arrangement when the cup is accidentally knocked over onto its side or being transported in a filled state for later use.

To overcome difficulties in drinking from the cup by maintaining open flow paths, common solutions have been to use raised ribbed areas, which provide a pivoting means to open the valve.

A further disadvantage is in the valve configuration commonly used, in which the valve arrangement at the cup rim opens in the direction of liquid flow to allow the user to drink from the cup. It will be understood that when the valve system opens in the direction of liquid flow, it requires relatively low suction to open the valve for ease of drinking.

Since low suction is required for opening the valve, liquid can also leak out of the cup relatively easily. Since these cups traditionally seal at the rim where liquid is present, liquid may seep out, if knocked accidentally. Furthermore when the temperature of the liquid inside the cup increases, the internal pressure also increases causing the valve to open, resulting in leakage.

A further safety issue with some cup valve assemblies is that the flexible valve member can be completely removed from the cup by pulling on the flexible valve member from the outside of the cup.

This invention aims to obviate or mitigate one or more disadvantages associated with current non-spill drinking valves and non-spill drinking vessels which allow the user to drink from any position around the rim of the vessel whilst maintaining the vessel in a sealed condition in any orientation.

SUMMARY OF INVENTION

In a first aspect, there is provided a non-spill drinking valve system comprising a generally circular collar including a flange extending radially inwardly, an aperture defined by the flange and a circumferential drinking rim above the flange; a flexible valve member removably attachable to the collar, comprising a first lip that engages with a lower face of the flange to create a liquid seal, and a second lip which engages with the drinking rim of the collar; wherein, when pressure is applied to the flexible valve member, the first lip is caused to disengage from the lower face of the flange and the second lip is caused to disengage from the drinking rim of the collar.

That is to say, the non-spill drinking valve system includes a collar that is generally circular in shape. The collar includes a flange extending radially inwardly, and provides an aperture that may be located centrally within the collar, as defined by the flange. The outermost portion of the collar provides a circumferential drinking rim, wherein the drinking rim is above the flange, or may be regarded as the uppermost rim.

There is also a flexible valve member, which can be removably attached to the collar, particularly removably attached about the flange. The flexible valve member includes a first lip and a second lip, or a lower lip and an upper lip. The first lip engages with a lower face of the flange, in use, to provide a liquid seal. The second lip engages with the circumferential drinking rim, in use, and may also provide a liquid seal.

When a user applies pressure to the flexible valve member, typically at an upper point of the second lip, or indeed anywhere else about the flexible valve member, the first lip is caused to disengage from the lower face of the flange. That is, the liquid seal provided at the point of engagement between the first lip and the lower face of the flange may be broken to allow fluid to flow. Additionally, the second lip is caused to disengage from the drinking rim of the collar. That is, a created liquid seal between the second lip and the drinking rim may be broken to allow fluid to flow.

In this way, the first lip may be caused to disengage in a direction that is against the direction of fluid flow. That is, in use, when pressure is applied to the flexible valve member, the first lip may be caused to disengage with the lower face of the flange against the direction of fluid flow, thereby allowing fluid to flow.

This provides the advantage that the drinking valve system includes a double liquid seal, so as to prevent spillage from the system. Moreover, the valve opening and closing against the flow of fluid ensures a more reliable seal, and provides the user with more control over the fluid flow. Moreover, the flexible valve member is readily assembled to the collar, but cannot be removed with ease by an infant, in use.

Optionally, the first lip may include one or more flow holes.

That is, the first lip may include, about its circumference, a plurality of holes to allow fluid to flow when the first lip is caused to disengage with the lower face of the flange.

This provides the advantage that a steady stream of fluid is allowed to flow when the first lip is caused to disengage. That is, the user experiences better flow control in use.

Optionally, when pressure is applied to the flexible valve member, the first lip may be caused to disengage with the lower face of the flange, thereby allowing fluid to flow through the one or more flow holes.

That is, when pressure is applied at any point about the flexible valve member, including the second lip, the first lip may be caused to disengage and break the liquid seal that is formed at the interface between the first lip and the lower face of the flange. In this way, a fluid flow path is opened to allow fluid to flow through this created path, through the flow holes, and out of the system.

Optionally, the first lip may include a first portion and a second portion, wherein the first and second portions are spaced apart by the or each flow hole.

That is, the flow holes may each separate the first lip into a first portion and a second portion.

Optionally, the first portion of the first lip may engage with the lower face of the flange when no pressure is applied to the flexible valve member, thereby creating a liquid seal.

That is, in use, when no pressure is applied to the flexible valve member a liquid seal is maintained between the first portion of the first lip and the lower face of the flange. Once pressure is applied to the flexible valve member, at any point including the second lip, this liquid seal is caused to break. That is, the first portion is caused to disengage with the flange, thereby allowing fluid to flow.

Optionally, the first portion of the first lip may disengage with the lower face of the flange when pressure is applied to the flexible valve member, thereby allowing fluid to flow through one or more of the elongate flow holes.

That is, in use, when no pressure is applied to the flexible valve member a liquid seal is maintained between the first portion and the lower face of the flange, thus preventing the flow of fluid through the flow holes. Once pressure is applied to the flexible valve member, at any point including the second lip, the first portion is caused to disengage with the lower face of the flange, thereby opening a fluid flow path, including the flow holes. That is, the first portion is caused to disengage with the flange, thereby allowing fluid to flow through the flow holes and out of the system.

Optionally, the second portion of the first lip may include an upper circumferential rib and a lower circumferential rib.

That is, the second portion may include an upper rib, or groove, about the entirety of, or indeed part of, the second lip. Additionally, the second portion may include a lower rib, or groove, about the entirety of, or indeed part of, the second lip.

This provides the advantage that the flexible valve member may be correctly located and sealed within the collar, and between the collar and a cup base.

Optionally, the second lip may create an additional liquid seal with the circumferential drinking rim.

That is, a liquid or fluid seal may be formed at the interface between the drinking rim and the second lip.

This provides the advantage that any excess fluid trapped within the void of the lid, or collar, is held in place until the user continues to drink from the system. That is, spillage from liquid trapped in the collar is prevented.

Optionally, the flow holes are spaced entirely around the first lip.

That is, flow holes may be positioned substantially entirely, or entirely, or the most part around the first lip.

This provides the advantage that the user can drink from all around the system, and also experiences the same liquid control about the entire circumference of the system.

Optionally, the flow holes are spaced equidistant with respect to one another.

That is, the spacing, or distance, from one flow hole to another flow hole is consistent between each pair of flow holes. That is, the spacing is the same between each and every flow hole.

This provides the advantage that the user can experience the same liquid control when drinking about the entire circumference of the system.

Optionally, the non-spill drinking valve system may further include a void between an upper face of the flange and a lower face of the second lip.

That is, a void, space or otherwise a gap, may be formed between the upper face of the flange and the lower face of the second lip. The void may further be defined by a portion of the flexible valve member, specifically a wall between the first lip and the second lip; and a wall of the collar.

Further, the flange may include a concave wall. That is, the flange may include a wall that is curved in a concave manner. Said wall may serve to define the void, space or otherwise a gap between the wall and the flexible valve member.

The void, space or gap may be formed circumferentially between the upper face of the flange, the wall, the second lip and the flexible valve member.

This provides the advantage that any residual fluid is trapped within the void, such that it is contained within the void so as to not spill therefrom. That is, the void provides a volume in which excess undrunk fluid can be stored. When a user continues drinking, they will then remove the fluid from this void in the usual manner.

Optionally, an upper face of the flange may include a series of grooves spaced apart entirely around the flange.

That is, on the upper face of the flange, there is provided a series of grooves, channels, indentations or the like spaced apart around the circumference of the flange at its upper face.

Optionally, the upper face of the flange includes a series of ribs formed between each groove.

That is, a series of ribs, ridges or the like are spaced apart around the circumference of the flange at its upper face. The ribs, ridges or the like may be formed between each groove.

The grooves, channels, indentations and/or ribs, ridges or the like may cooperate to provide a pivot point when the user drinks from the system. This pivot point allows the flexible valve member to more readily cause a disengagement of the first lip from the flange, to thereby allow the user to drink fluid more readily.

In another aspect of the non-spill drinking valve system, the collar may include an upper wall forming the flange; and a lower truncated conical wall, wherein the lower truncated conical wall includes one or more flow holes, and includes the aperture located centrally therein.

That is, the collar may include a first wall, or an upper wall, which is formed as, or as part of, the flange. The collar may also include a second wall, or a lower wall, that is truncated and conical. That is, the second wall may follow the contours of a conical frustum, or otherwise protrudes at an angle to the horizontal.

That is to say, the second wall forms an angle to the horizontal plane formed at the point from which it protrudes. That is, the second wall protrudes downwardly at an angle.

Optionally, the upper wall includes a series of grooves spaced apart entirely around the upper wall.

That is, on the upper face of the upper wall, there is provided a series of grooves, channels, indentations or the like spaced apart around the circumference of the upper wall at its upper face.

Optionally, the upper wall may include a series of ribs formed between each groove.

That is, a series of ribs, ridges or the like are spaced apart around the circumference of the upper wall at its upper face. The ribs, ridges or the like may be formed between each groove.

The grooves, channels, indentations and/or ribs, ridges or the like may cooperate to provide a pivot point when the user drinks from the system. This pivot point allows the flexible valve member to more readily cause a disengagement of the first lip from the flange, to thereby allow the user to drink fluid more readily.

Optionally, the collar may include a sealing lug which engages with an inner wall of a cup base to provide a liquid seal.

That is, the collar may include one or more lugs protruding therefrom that are configured to engage with an inner wall of a cup base when assembled.

This provides the advantage that an additional liquid seal is maintained, thereby ensuring that no liquid may spill from the interface of the cup and the collar.

Optionally, the flexible valve member may include an annular ring which frictionally engages within the aperture to provide a liquid seal.

That is, the flexible valve member may further include an annular ring. The annular ring may be configured to frictionally engage within the aperture formed within the lower wall of the collar. This frictional engagement may provide a liquid or fluid seal.

In another aspect, there is provided a non-spill drinking cup system comprising a non-spill drinking valve system as described; and a cup base.

This provides the advantage that the flexible valve member can be readily removed, for cleaning or the like, whilst still maintaining a liquid seal in use.

Optionally, the cup base and the collar are secured by screw thread, a push-fit, a clip-fit, or the like.

This provides the advantage of a secure engagement between the cup base and collar, whilst allowing for easy disassembly.

Optionally, the flexible valve member is frictionally engaged between the collar and the cup base.

This provides the advantage that an additional liquid seal is provided between the collar and the cup base, so as to further prevent spillage.

That is, in some embodiments of the invention, a secure drinking vessel valve assembly is provided, which is tamper proof and cannot be removed by the infant whilst in use.

In some examples, the flexible valve member may be securely locked between the cup base and lid collar and cannot be removed by pulling.

In some embodiments, a valve system may be provided which seals the contents of the cup securely at an underside of an inner concentric ring of the collar.

In some embodiments, a valve may be provided which opens against the flow of liquid, when suction is applied to the cup.

In some embodiments, a valve may be provided that seals more tightly as pressure and temperature inside the cup increases. That is, as pressure and/or temperature within the cup base increases, the liquid seal(s) provided within the system are biased towards engagement, i.e. closure, thereby controlling the ease in which a user can drink from the cup.

In some embodiments, the directional flow of liquid may be controlled and maintained through a plurality of ribbed flow channels around the upper surface of the lid/collar when lip pressure is applied between the valve and collar.

In some embodiments, venting is provided around the rim, which allows air to vent between the extreme edge of the valve, i.e. at the circumferential edge of the second lip and the collar at the circumferential drinking rim. Air pressure may then open the compression seal and allow air to continue to flow through the liquid flow holes and into the cup.

In some embodiments of the invention, a pressurised "Lip Trap" at the cup rim is eliminated thereby providing improved comfort in use.

In some embodiments, the non-spill cup and/or fluid control valve system, with all round drinking rim, is made using a flexible material such as silicone or similar suitable food contact approved thermoplastic elastomers, having a typical shore A hardness of 20-60.

In some embodiments, the system may allow the user to drink from any point of the circumferential drinking rim.

BRIEF DESCRIPTION OF THE DRAWINGS

According to some described aspects, there is a drinking cup base, a flexible valve member and lid assembly system, as discussed in detail below.

The accompanying drawings illustrate presently exemplary embodiments of the disclosure and together with the general description given above and the description of the embodiments given below serve to explain by way of example only the principles of the disclosure.

In the accompanying drawings:

FIG. 1 shows an isometric view of the assembled non-spill drinking vessel;

FIG. 2 shows an orthographic view of the assembled non-spill drinking vessel from the side;

FIG. 3 shows an orthographic view of the assembled drinking vessel from below;

FIG. 4 shows an orthographic view of the assembled drinking vessel from above;

FIG. 5 shows an orthographic sectional side view of the drinking vessel assembly through the centreline, including a hygienic cover;

FIG. 6 shows an orthographic sectional view through the centreline of the flexible valve member;

FIG. 7 shows an orthographic enlarged sectional view through the centreline of the flexible valve member from the side;

FIG. 8 shows an isometric view of the flexible valve member viewed from the underside;

FIG. 9 shows an orthographic view of the flexible valve member from above;

FIG. 10 shows an orthographic view of the flexible valve member from the side;

FIG. 11 shows an enlarged orthographic sectional view of the drinking vessel assembly through the centreline of the drinking vessel from the side with the valve in the sealed position;

Figure 12:
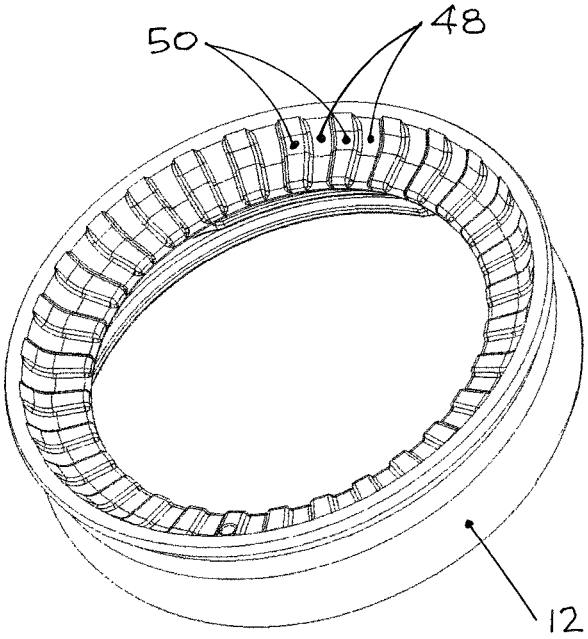
Figure 13:
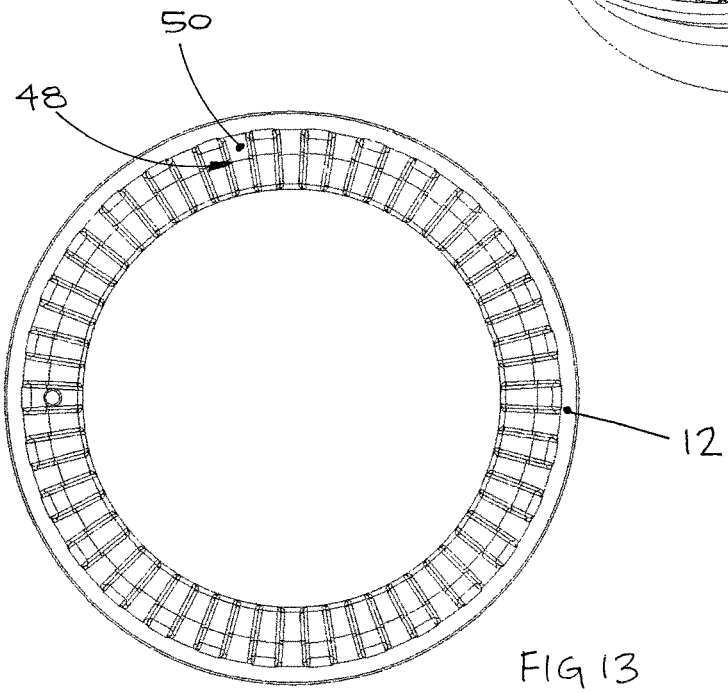
Figure 14:
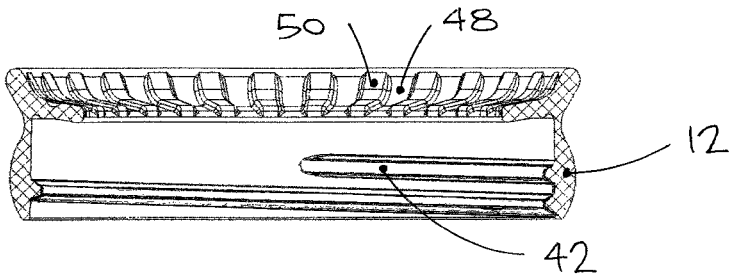
Figure 15:
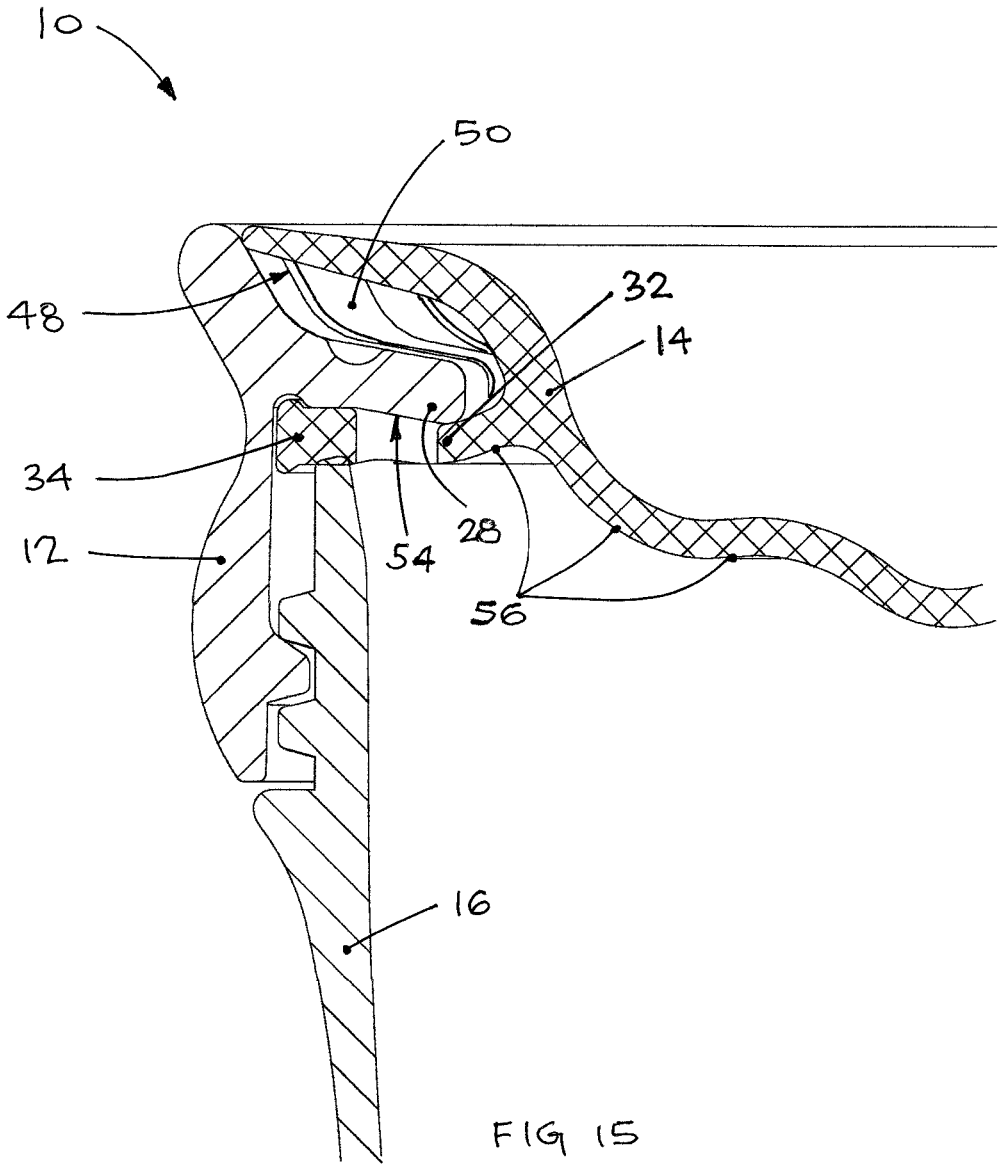
Figure 16:
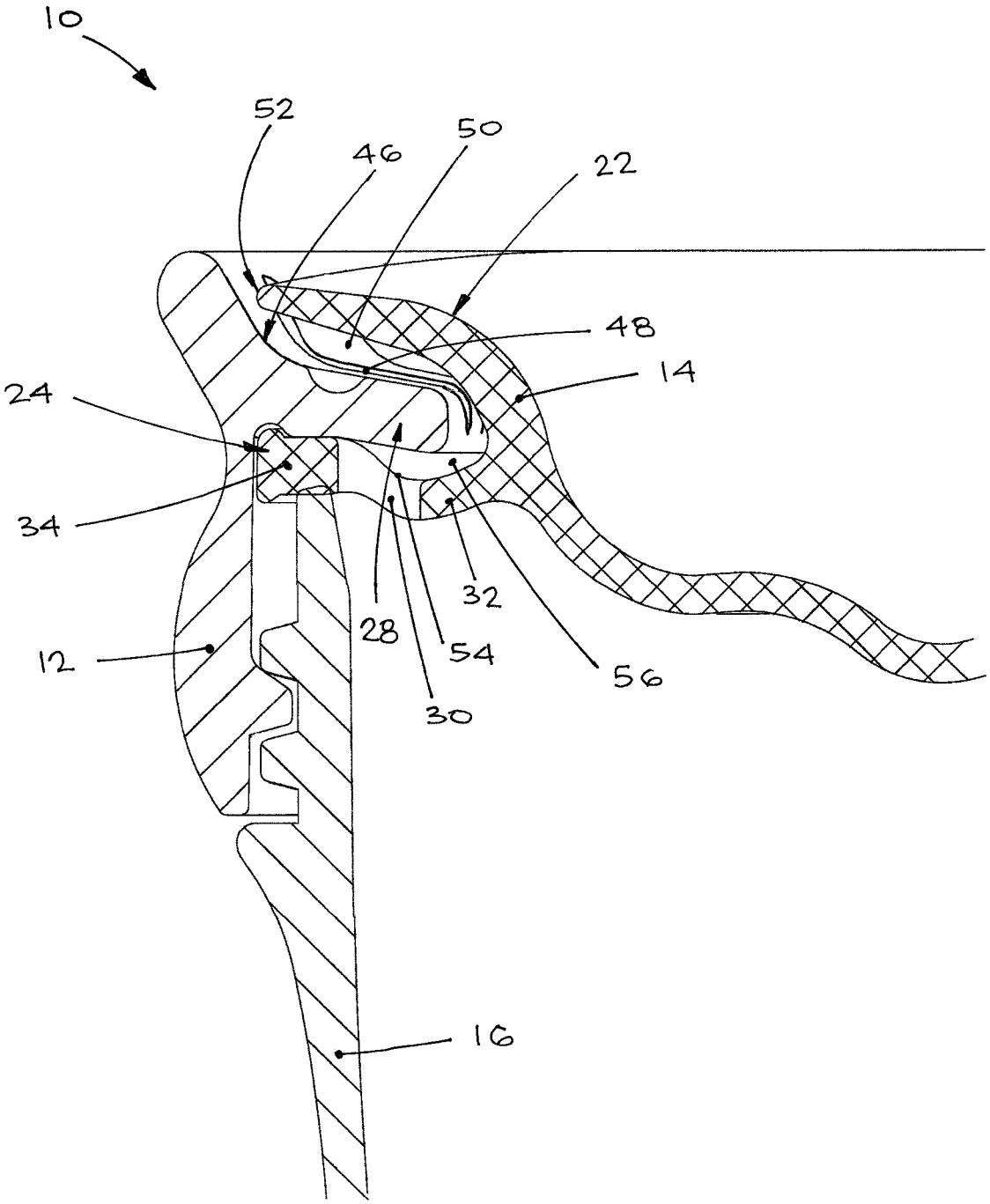
Figure 17:
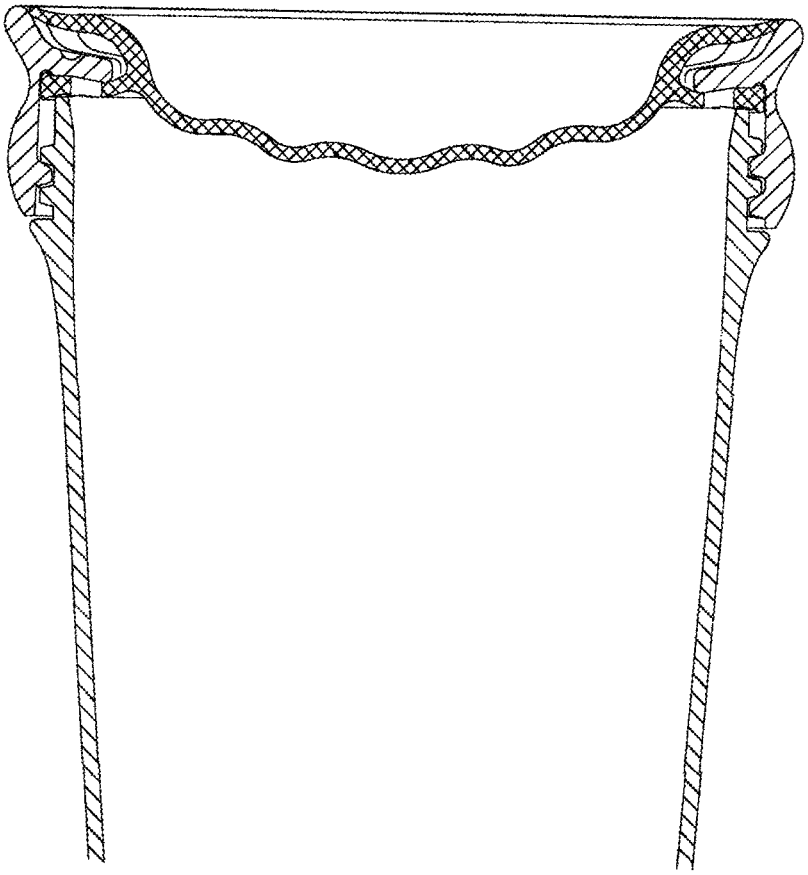
Figure 18:
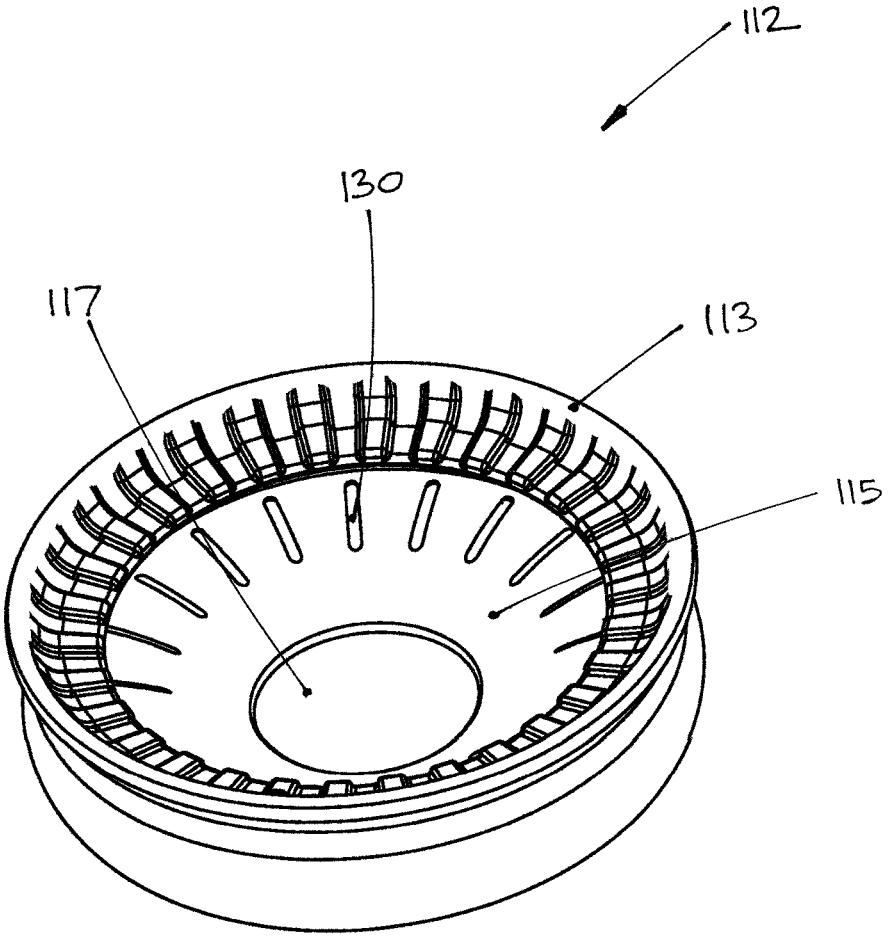
Figure 19:
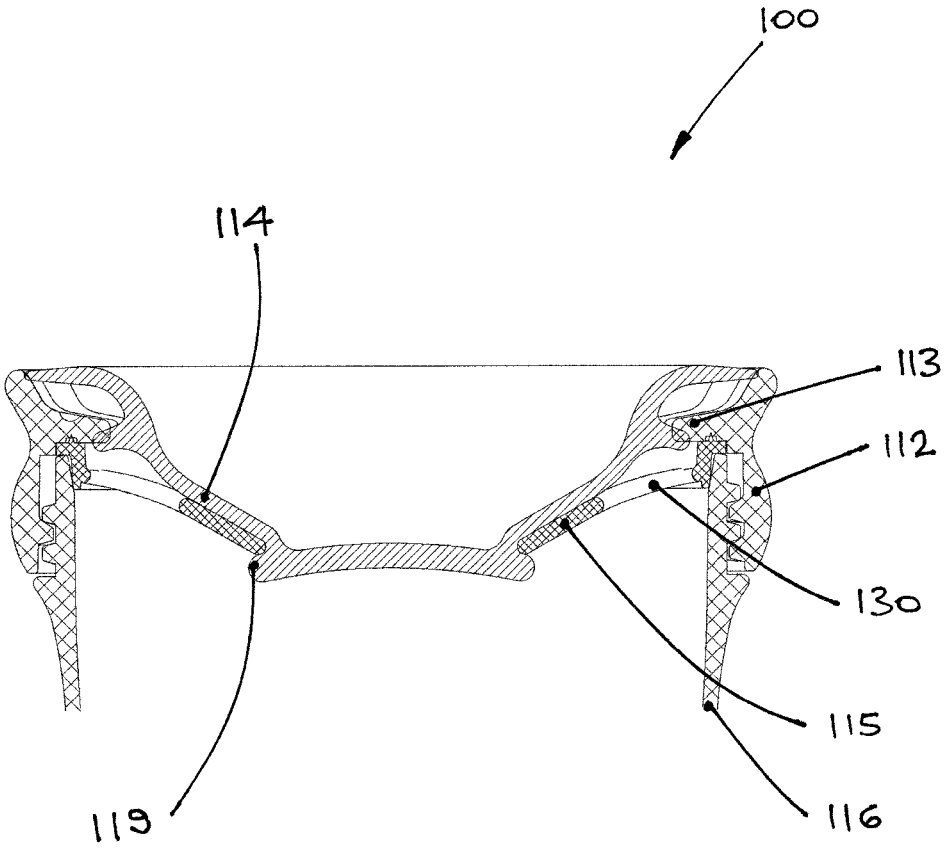
Figure 20:
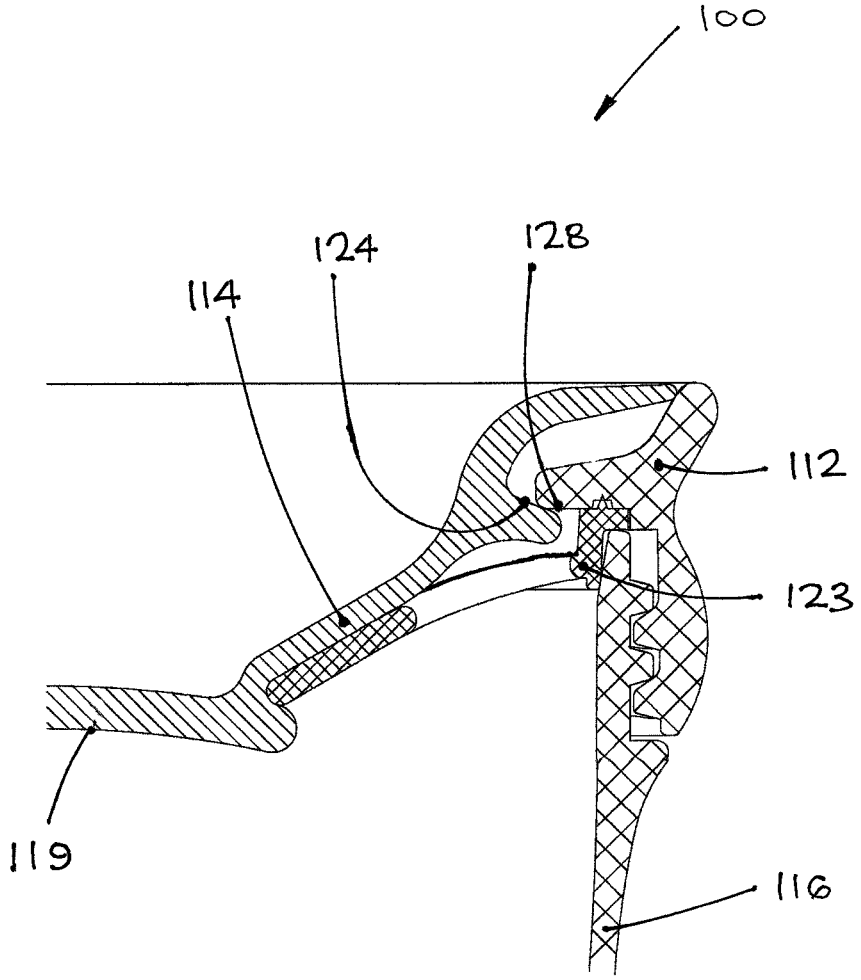
Figure 21:
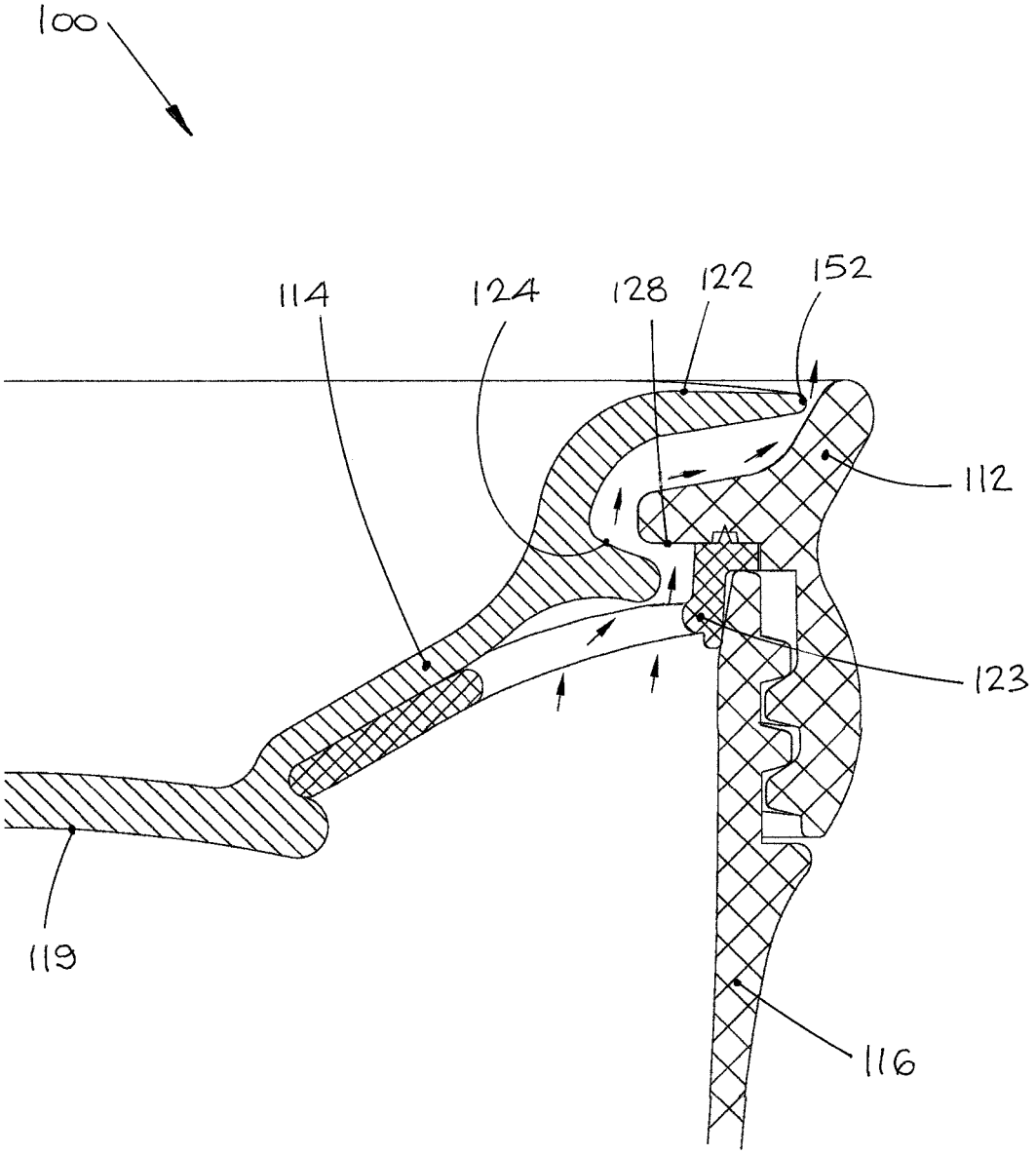

FIG. 12 shows an isometric view of the collar;

FIG. 13 shows an orthographic view of the collar from above;

FIG. 14 shows an orthographic sectional side view through the centreline of the collar;

FIG. 15 shows another further enlarged orthographic sectional view of the drinking vessel assembly through the centreline of the drinking vessel from the side, with the valve in the sealed position;

FIG. 16 shows another further enlarged orthographic sectional view of the drinking vessel assembly through the centreline of the drinking vessel from the side, with the valve in the open position;

FIG. 17 shows an orthographic enlarged sectional view of the drinking vessel assembly through the centreline of the drinking vessel from the side;

FIG. 18 shows an isometric view of another aspect of the collar, viewed from above;

FIG. 19 shows an orthographic sectional view through the centreline of the cup assembly of the second aspect, viewed from the side;

FIG. 20 shows an enlarged orthographic part sectional view of the cup assembly of the second aspect, viewed from the side with the valve in the closed condition; and FIG. 21 shows an enlarged orthographic part sectional view through the cup assembly of the second aspect, viewed from the side with the valve in the open condition.

DETAILED DESCRIPTION

With reference to FIGS. 1-5, there is provided a non-spill drinking cup system 10, including a collar 12 and a flexible valve member 14, wherein the flexible valve member 14 is removably attachable to the collar 12. The collar 12 and the flexible valve member 14 provide a non-spill drinking valve system.

Figure 1:
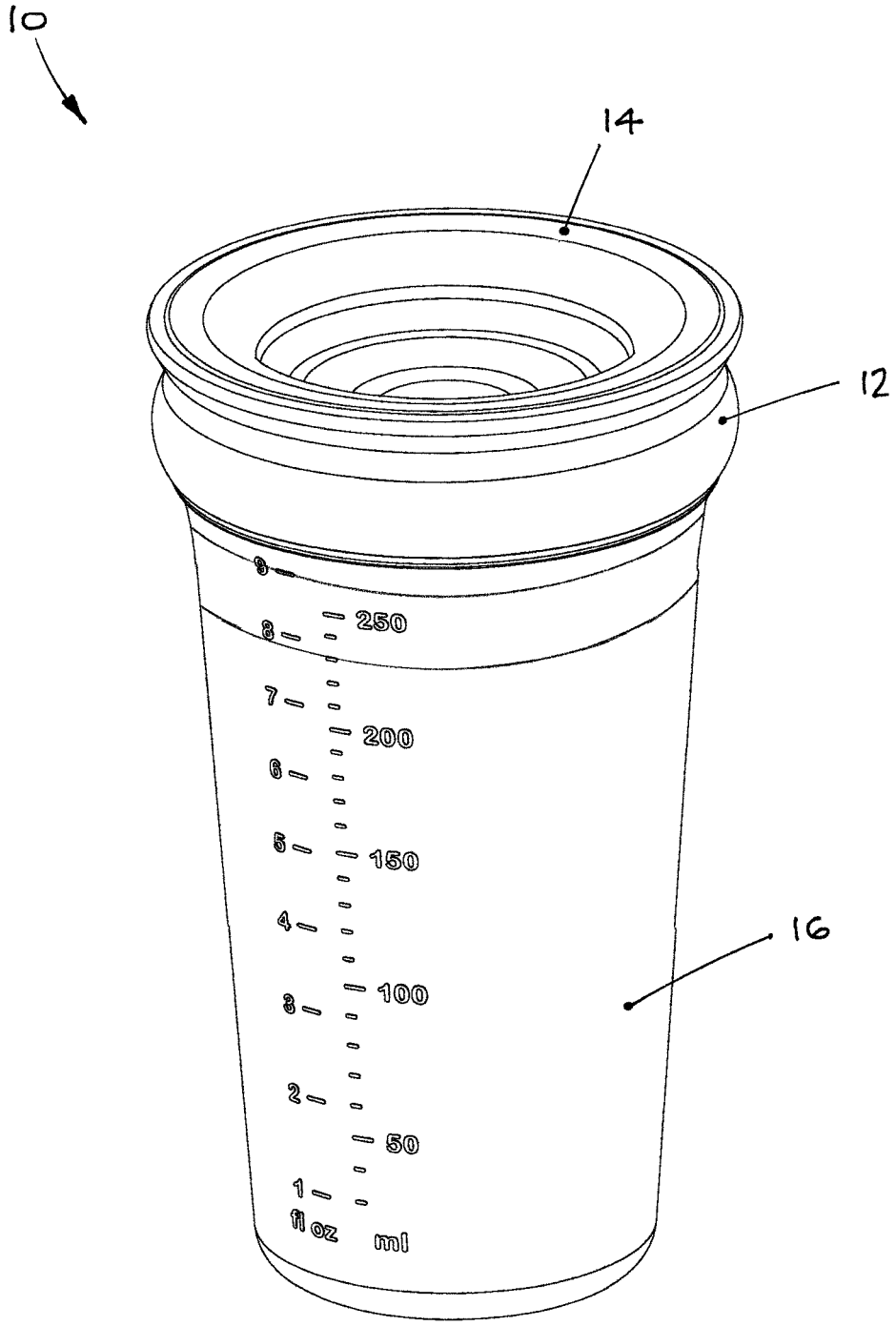
Figure 2:
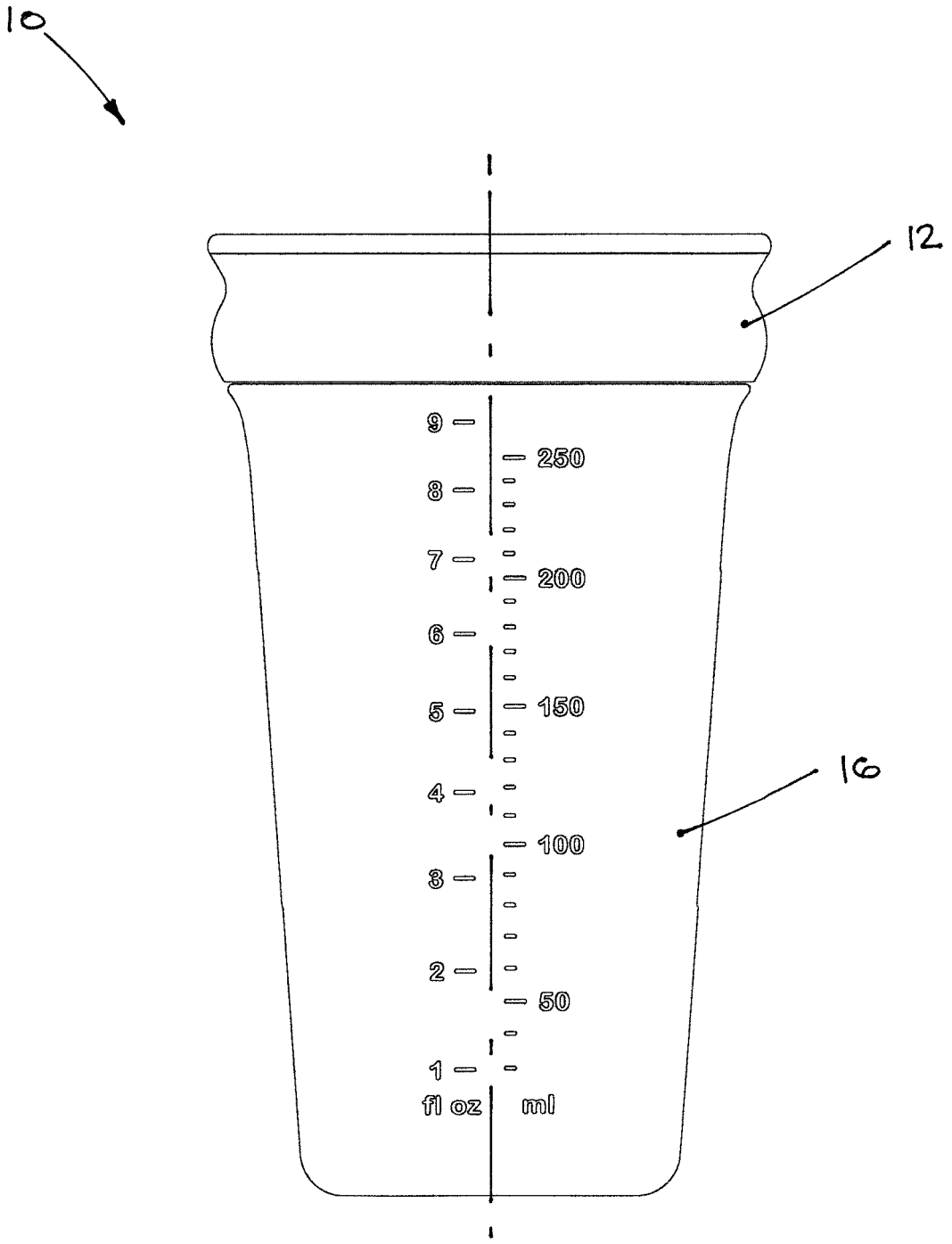
Figure 3:
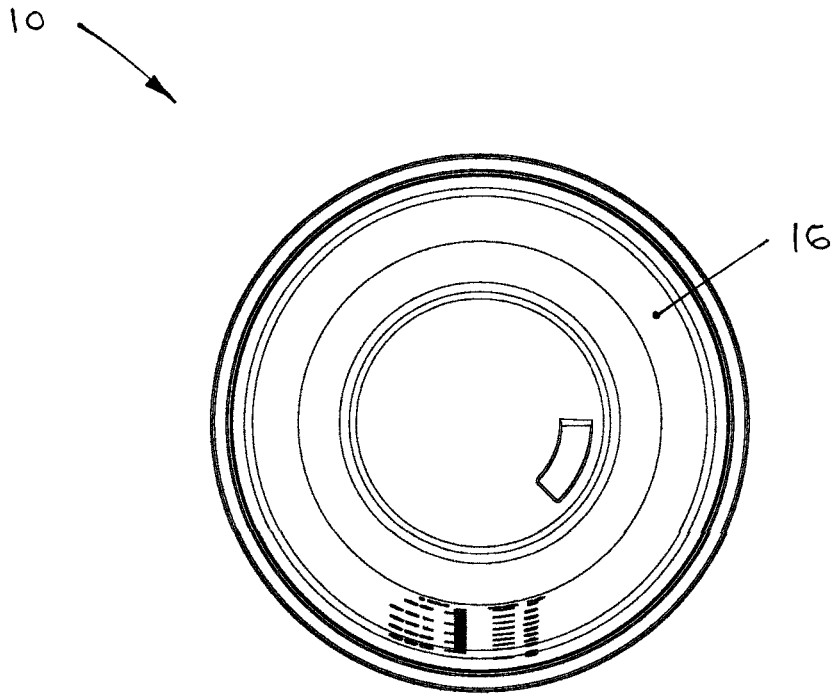
Figure 4:
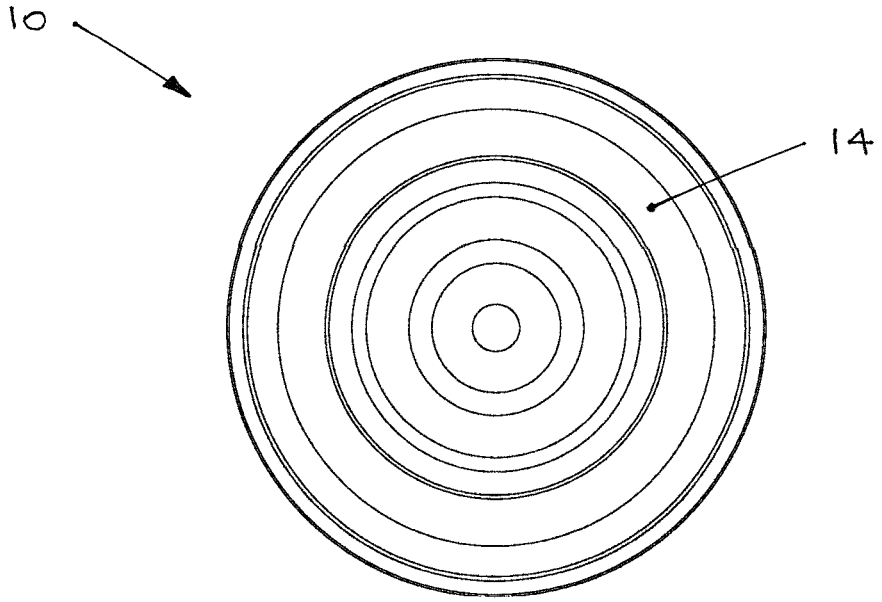
Figure 5:
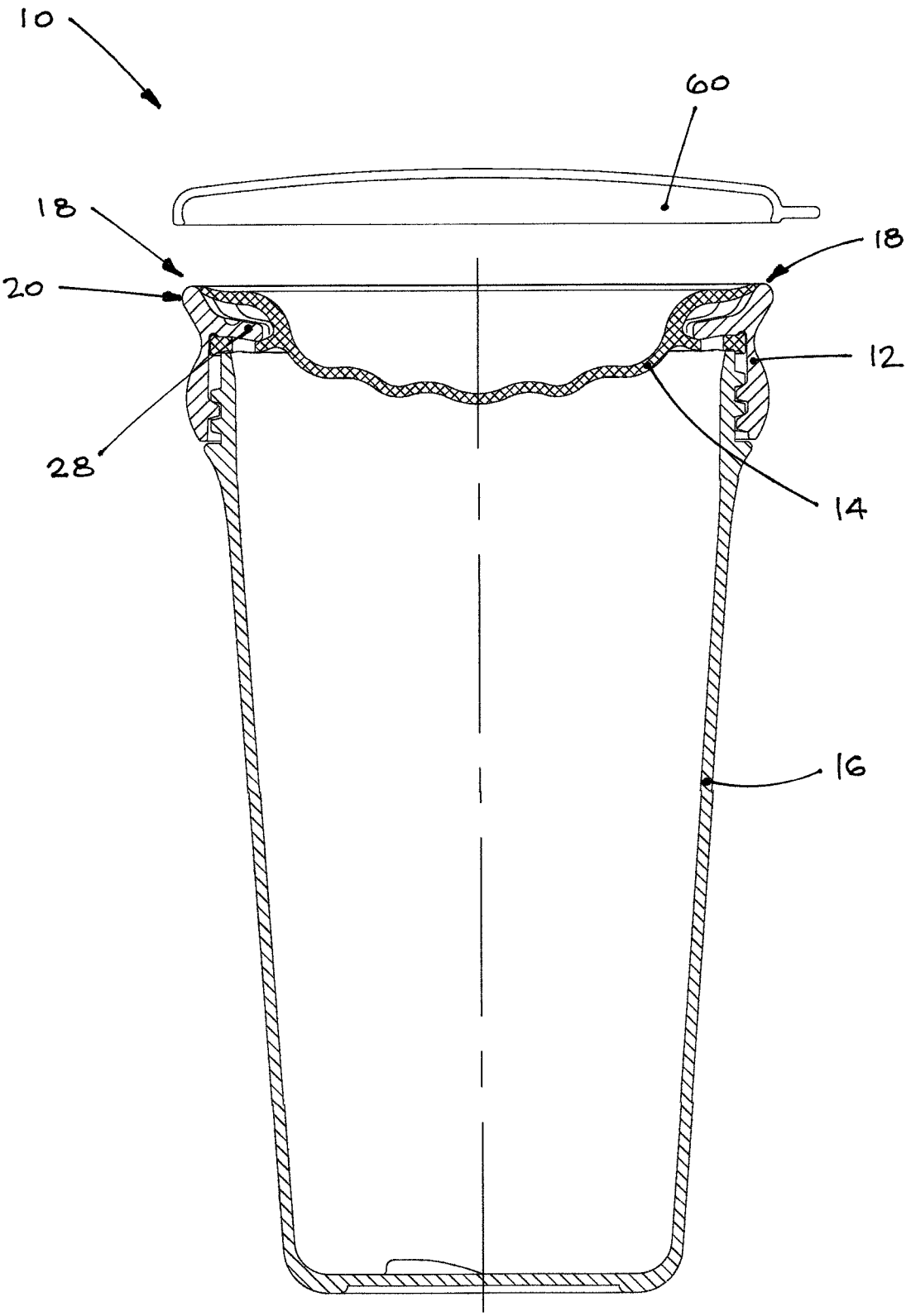

As shown best in FIG. 5 the drinking cup system 10 includes a drinking vessel, cup or container 16, a collar 12 and flexible valve member 14 which, when the flexible valve member 14 is assembled to the collar 12, forms a circumferential drinking groove 18, which extends around the entire circumference of the rim 20 of the collar 12. The collar 12 also includes a circumferential flange 28, which receives the flexible valve member 14 as described below. The non-spill drinking cup system 10 may also include an optional clip-on cover 60.

Figure 6:
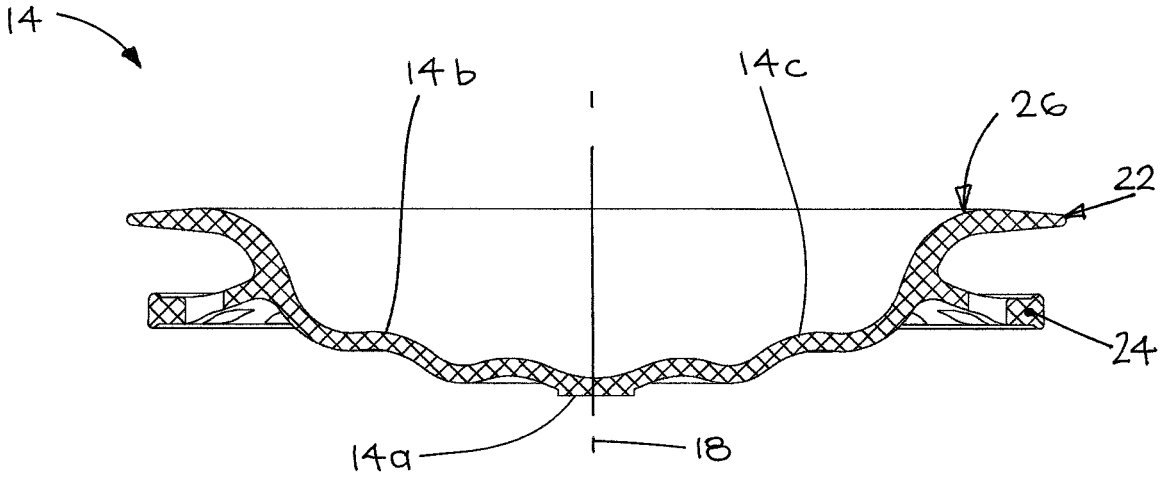

With reference to FIG. 6, the flexible valve member 14 is generally circular in shape and may be gradually indented and concave towards the base 14*a* of the flexible valve member 14 thereby creating generally annular portions 14*b*, 14*c*. The annular portions 14*b*, 14*c* are each concentric with the central axis A of the valve and terminate at the base 14*a*.

With further reference to FIG. 6, the flexible valve member 14 includes an upper, or first, lip 22 and a lower, or second, lip 24. The upper and lower lips 22, 24 form a spool shape comprising an upper convex curved rim 26. As is made clear in FIG. 5, the circumferential gap between the upper and lower lips 22, 24 receives the flange 28 of the collar 12.

Figure 7:
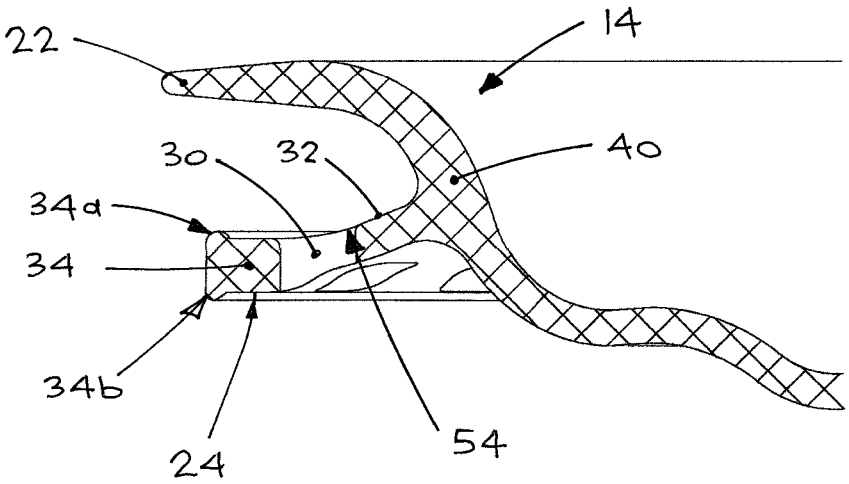
Figure 8:
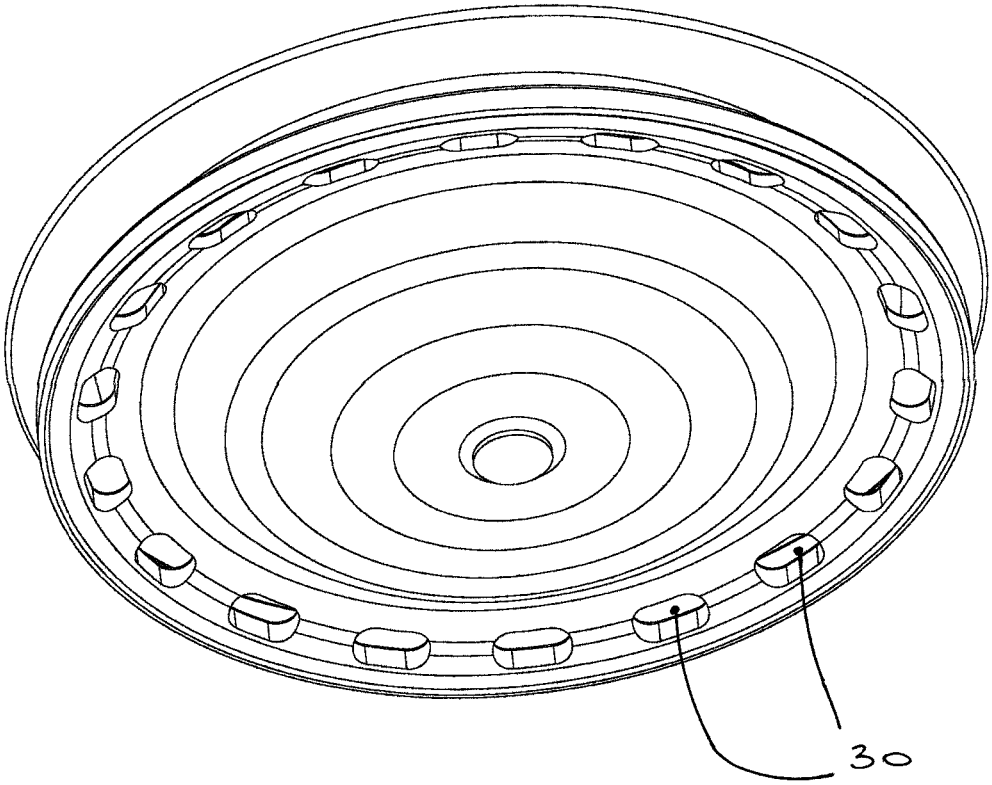
Figure 9:
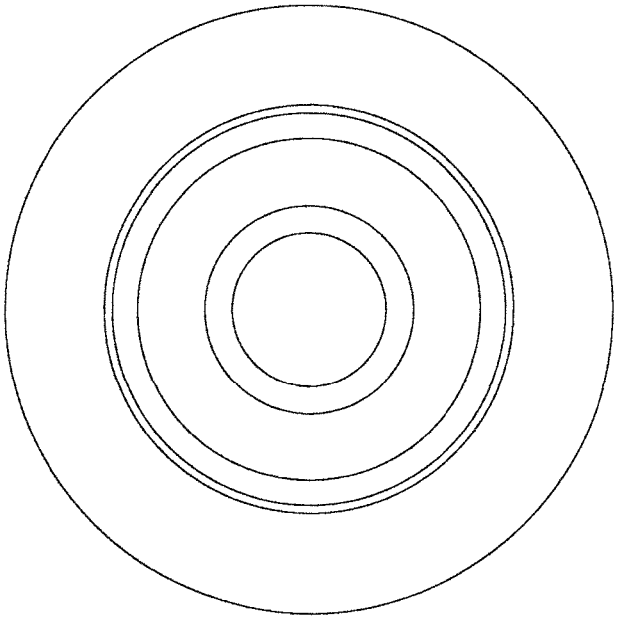
Figure 10:
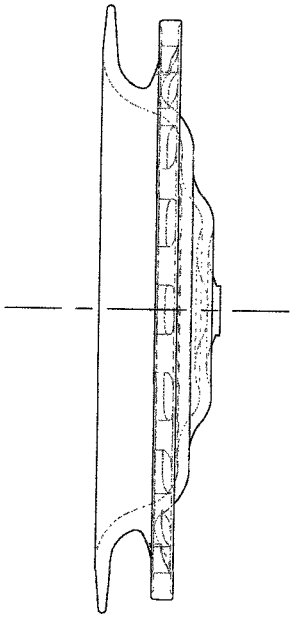

With reference to FIGS. 7 and 8, the lower lip 24 includes a series of elongate flow holes 30. The flow holes 30 are spaced apart equally, or in other words are equispaced, or equidistant with respect to one another, about the circumference of the lower lip 24. The lower lip 24 also includes a first portion 32 and a second portion 34. The first and second portions 32, 34 are spaced apart by the flow holes 30. Additionally, the second portion 34 of the lower lip 24 is generally T-shaped, and thus includes an upper circumferential rib 34*a* and a lower circumferential rib 34*b*.

Figure 11:
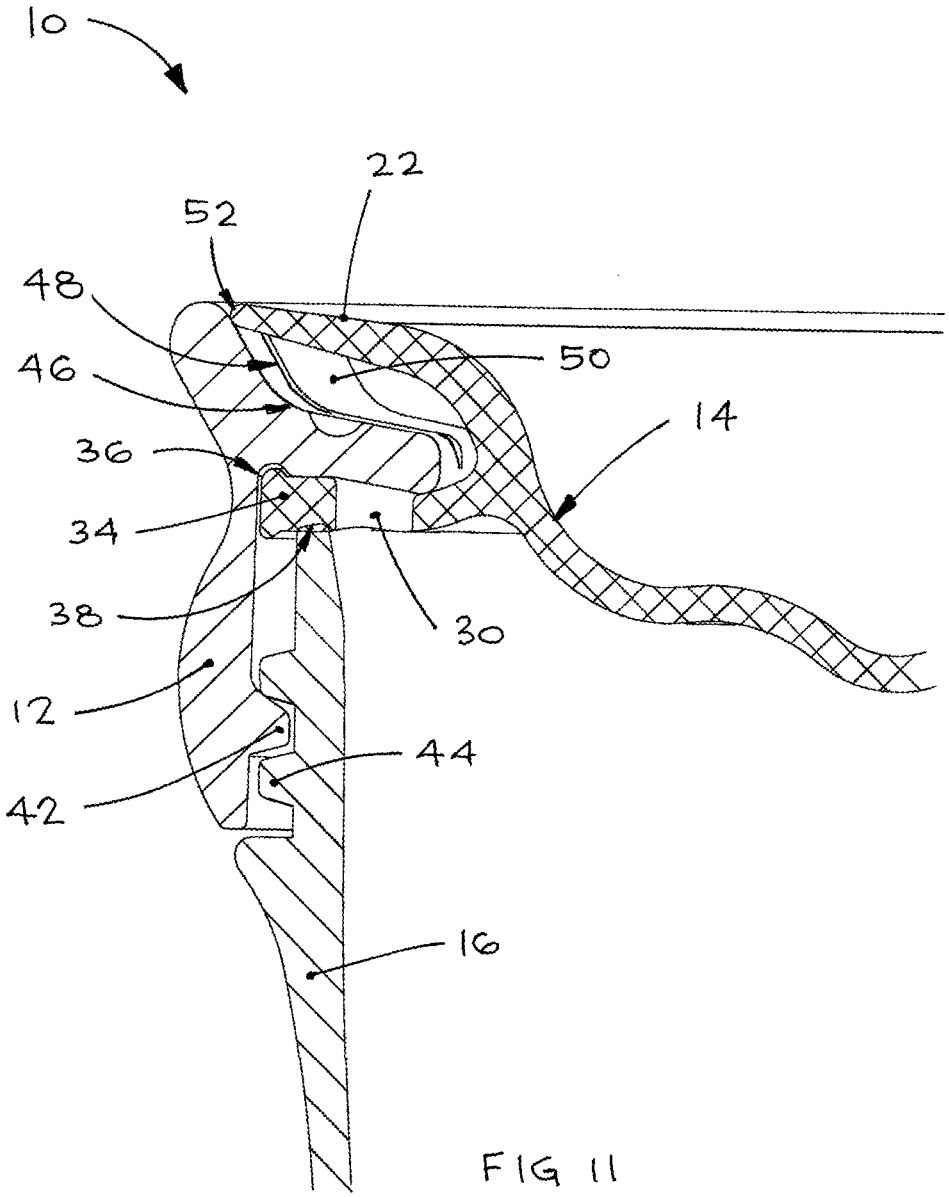

As best shown in FIG. 11, the upper circumferential rib 34*a* frictionally engages with a groove 36 of the collar 12 in use. Additionally, the underside of the second portion 34 of the lower lip 24 frictionally engages with the circumferential rim 38 of the cup base 16. Thus, the lower lip 24 is held in frictional engagement between the underside of the flange 28 of the collar 12, and the circumferential rim 38 of the cup base. This also secures the flexible valve member 14 to the cup base 16 in use, and thus prevents the flexible valve member 14 from being removed from the non-spill drinking cup system 10 when in use.

With further reference to FIGS. 7 and 11, it can be seen that the lower lip 24, in its unassembled condition (FIG. 7), is positively inclined. Specifically, the first portion 32 and the second portion 34 include an inner truncated conical wall 54, which is inclined when in an unassembled condition. The first portion 32 is connected to a central wall portion 40, wherein the central wall portion 40 connects the upper lip 22 to the lower lip 24. The upper lip 22, the lower lip 24, and the central wall portion 40 form a substantially U-shaped cross-section for receiving the collar 12 therein.

With reference to FIGS. 11-14 the collar 12 is circular in shape, the lower half of which comprises a screw thread 42, which engages with the cup screw thread 44 to secure the collar 12 to the cup 16.

The upper half of the collar 12, specifically the flange 28, comprises a generally concave wall 46 into which a series of grooves 48 are positioned which extend around the circumference, in the general direction of the central axis of the collar 12. A series of ribs 50 are formed between the grooves 48, and frictionally engage with the distal circumferential end 52 of the upper lip 22 of the flexible valve member 14, so that when lip pressure is applied between the collar 12 and the upper lip 22 of the flexible valve member 14, a fluid flow path is maintained.

Referring now to FIG. 15, which shows the collar 12, the flexible valve member 14, and the cup base 16 in the assembled condition—it will be evident that the wall 54 of the flexible valve member 14, has been deflected and flexed in a downward direction by the corresponding flange 28, of the collar 12. At the interface contact surfaces between the collar 12 and the lower lip 24 of the flexible valve member 14, a secure liquid compression seal is formed.

It will also be understood that as internal pressure builds up inside the drinking vessel, as it is known to do for example when a chilled liquid temperature rises from approximately 5 Degrees Celsius to ambient temperature or above, the increased internal pressure generated inside the drinking vessel applies increased pressure to the underside of the lower lip 24 and a lower surface 56 of the flexible valve member 14 (see FIG. 15), which forces the liquid seal between the collar 12, and the flexible valve member 14, more tightly closed to prevent any liquid leaking out of the vessel. It will therefore be understood that when lip pressure is applied the valve opens against the flow of liquid.

FIG. 16 indicates how the flexible valve member 14 flexes when pressure is applied to the upper lip 22 of the flexible valve member 14. This pressure is cascaded and transferred to the lower lip 24 such that the flexible valve member 14 flexes at the wall 54 and the first portion 32 of the lower lip 24, in a downward direction, and in so doing opens a liquid flow path 56 between the wall 54, and the flange 28 of the collar 12, to allow liquid to flow through the opening 58.

Downward pressure to the upper lip 22 of the flexible valve member 14 flexes the valve downwardly thus causing the lower lip 24 also to flex in a downward direction thereby opening up a liquid flow path 56 so that liquid can flow through the flow holes 30, through the liquid flow path 56 and out between the distal end 52 of the upper lip 22 and the concave surface 46 of the collar 12. The grooves 48, in the collar 12, ensure that a liquid flow path between the flexible valve member 14 and collar 12 is maintained when lip pressure is applied whilst drinking.

FIGS. 18 and 19 show an alternative embodiment of a collar 112 for use with an alternative non-spill drinking cup valve system 100, which includes a flexible valve member 114 and a cup base 116. The collar 112 includes an upper, or outer, wall 113 and a lower, or inner, truncated conical wall 115 including one or more flow holes 130, shown in this embodiment as radial slots, which allow liquid to flow through the holes 130 in the lower truncated conical wall 115 when the non-spill drinking cup valve system 100 is used in the drinking position.

The non-spill drinking cup system 100 includes a flexible valve member 114 that is shaped to closely follow the contours of the collar 112. That is, the flexible valve member 114 is of complementary shape to the collar 112. The flexible valve member 114 frictionally engages with a central hole 117 of the collar 112. Specifically, the flexible valve member 114 includes a lower annular ring 119 to ensure that a secure fitting between the flexible valve member 114 and the collar 112 is maintained.

Turning now to FIGS. 20 and 21, once the flexible valve member 114 and the collar 112 are assembled, a lower lip 124 of the flexible valve member 114 applies pressure to the collar 112 at a flange 128, thus maintaining the assembled cup in a sealed condition.

As can be seen in FIGS. 20 and 21, the collar 112 includes a screw thread 146 which engages with a corresponding screw thread 144 of the cup base 116. The collar also includes a sealing lug 123 for providing a liquid seal between the collar 112 and the cup base 116.

With further reference to FIGS. 20 and 21, as internal pressure inside the cup increases, the sealing force between the flexible valve member 114 and the collar 112 increases, ensuring that the cup remains in the sealed condition at the lower lip 124. Upon application of lip pressure to an upper lip 122 of the flexible valve member 114, the lower lip 124 of the flexible valve member 114 is deflected away from the flange 128 of the collar 112, allowing liquid to flow and exit the system 100 between the distal end 152 of the upper lip 122 and the collar 112 as indicated by the arrows.

To disassemble and separate the parts for cleaning, the flexible valve member 114 and collar 112 are first unscrewed from the cup base 116 and pressure applied to the flexible valve member 114 at the centre of its inner surface to separate the flexible valve member 114 from the collar 112.

In the embodiment depicted in FIGS. 18-21, as liquid is dispensed from the system 100 during each suck-cycle, negative pressure (vacuum) gradually builds up inside the cup base 116 until a pre-determined level of vacuum is achieved, at which point air is allowed to vent between the distal edge 152 of the upper lip 122, and the collar 112, then on through a gap which opens up between the flange 128 of the collar 112, and the lower lip 124. It will also be understood that the seal between the collar 112 and the lower lip 124 opens in the direction of air-flow venting back inside the drinking vessel as the pressure inside the drinking vessel reduces. Venting the drinking vessel in a continuous manner whilst drinking, eliminates the need for a separate pressure equalizing valve means and delivers a valving system whose individual components and in particular the flexible valve are more robust and less likely to malfunction due to damage sustained through regular use.

With reference to FIG. 5, a hygienic cover 60, may be used to ensure the top of the drinking vessel is kept in a clean condition for subsequent use.

The invention claimed is:

1. A non-spill drinking valve system comprising:

a generally circular collar including a flange extending radially inwardly, an aperture defined by the flange and a circumferential drinking rim above the flange;

a flexible valve member removably attachable to the collar, comprising a first lip that engages with a lower face of the flange to create a liquid seal, and a second lip which engages with the drinking rim of the collar; and wherein, when pressure is applied to the flexible valve member, the first lip is caused to disengage from the lower face of the flange and the second lip is caused to disengage from the drinking rim of the collar.

2. The non-spill drinking valve system according to claim 1, wherein the first lip comprises one or more flow holes.

3. The non-spill drinking valve system according to claim 2, wherein, when pressure is applied to the flexible valve member, the first lip is caused to disengage with the lower face of the flange, thereby allowing fluid to flow through the one or more flow holes.

4. The non-spill drinking valve system according to claim 2, wherein the first lip comprises a first portion and a second portion, wherein the first and second portions are spaced apart by the or each flow hole.

5. The non-spill drinking valve system according to claim 4, wherein the second lip creates an additional liquid seal with the circumferential drinking rim.

6. The non-spill drinking valve system according to claim 2, wherein the flow holes are spaced entirely around the first lip.

7. The non-spill drinking valve system according to claim 6, wherein the flow holes are spaced equidistant with respect to one another.

8. The non-spill drinking valve system according to claim 1, further comprising a void between an upper face of the flange and a lower face of the second lip.

9. The non-spill drinking valve system according to claim 1, wherein an upper face of the flange includes a series of grooves spaced apart entirely around the flange.

10. The non-spill drinking valve system according to claim 9, wherein the upper face of the flange includes a series of ribs formed between each groove.

11. The non-spill drinking valve system according to claim 1, wherein the collar comprises: an upper wall forming the flange; a lower truncated conical wall; and wherein the lower truncated conical wall includes one or more flow holes, and includes the aperture located centrally therein.

12. The non-spill drinking valve system according to claim 11, wherein the upper wall includes a series of grooves spaced apart entirely around the upper wall.

13. The non-spill drinking valve system according to claim 12, wherein the upper wall includes a series of ribs formed between each groove.

14. The non-spill drinking valve system according to claim 11, wherein the collar includes a sealing lug which engages with an inner wall of a cup base to provide a liquid seal.

15. The non-spill drinking valve system according to claim 1, wherein the flexible valve member includes an annular ring which frictionally engages within the aperture to provide a liquid seal.

16. A non-spill drinking cup system comprising:

a non-spill drinking valve system according to claim 1; and a cup base.

17. The non-spill drinking cup system according to claim 16, wherein cup base and collar are secured by screw thread, a push-fit or a clip-fit.

18. The non-spill drinking cup system according to claim 16, wherein the flexible valve member is frictionally engaged between the collar and the cup base.

19. A non-spill drinking valve system comprising:

a generally circular collar including a flange extending radially inwardly, an aperture defined by the flange and a circumferential drinking rim above the flange;

a flexible valve member removably attachable to the collar, comprising a first lip that engages with a lower face of the flange to create a liquid seal, and a second lip which engages with the drinking rim of the collar;

wherein, when pressure is applied to the flexible valve member, the first lip is caused to disengage from the lower face of the flange and the second lip is caused to disengage from the drinking rim of the collar;

wherein the first lip comprises one or more flow holes;

wherein the first lip comprises a first portion and a second portion, wherein the first and second portions are spaced apart by the or each flow hole; and wherein the first portion of the first lip engages with the lower face of the flange when no pressure is applied to the flexible valve member, thereby creating a liquid seal.

20. The non-spill drinking valve system according to claim 19, wherein the first portion of the first lip disengages with the lower face of the flange when pressure is applied to the flexible valve member, thereby allowing fluid to flow through one or more of the elongate flow holes.

21. A non-spill drinking valve system comprising:

a generally circular collar including a flange extending radially inwardly, an aperture defined by the flange and a circumferential drinking rim above the flange;

a flexible valve member removably attachable to the collar, comprising a first lip that engages with a lower face of the flange to create a liquid seal, and a second lip which engages with the drinking rim of the collar;

wherein, when pressure is applied to the flexible valve member, the first lip is caused to disengage from the lower face of the flange and the second lip is caused to disengage from the drinking rim of the collar;

wherein the first lip comprises one or more flow holes;

wherein the first lip comprises a first portion and a second portion, wherein the first and second portions are spaced apart by the or each flow hole; and wherein the second portion of the first lip comprises an upper circumferential rib and a lower circumferential rib.

* * * * *